US006227096B1

(12) United States Patent
Thomas

(10) Patent No.: US 6,227,096 B1
(45) Date of Patent: May 8, 2001

(54) UNIVERSAL WARHEAD ADAPTER, AND MISSILE AND METHOD INCORPORATING SAME

(75) Inventor: Larry James Thomas, Lawrenceville, GA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/337,925

(22) Filed: Jun. 22, 1999

(51) Int. Cl.[7] ..... F41F 3/06
(52) U.S. Cl. ..... 89/1.54; 244/137.4; 102/374
(58) Field of Search ..... 102/374, 379, 102/377; 244/120, 118.2, 137.4; 89/1.54

(56) References Cited

U.S. PATENT DOCUMENTS

| | | | | |
|---|---|---|---|---|
| 2,992,794 | * | 7/1961 | Boyd | 244/120 |
| 3,161,132 | * | 12/1964 | Siebert et al. | 102/374 |
| 3,699,891 | * | 10/1972 | Kreuzer et al. | 102/374 |
| 3,937,124 | | 2/1976 | Krumes | 89/6.5 |
| 4,187,761 | | 2/1980 | Holt et al. | 89/1.5 R |
| 4,660,456 | | 4/1987 | Griffin et al. | 89/1.819 |
| 4,829,878 | | 5/1989 | Thompson | 89/1.54 |
| 5,363,737 | | 11/1994 | Wallis | 89/1.54 |
| 5,363,767 | * | 11/1994 | Robinson | 102/374 |
| 5,406,876 | | 4/1995 | Harless et al. | 89/1.54 |
| 5,773,751 | | 6/1998 | Fredriksson et al. | 102/473 |

OTHER PUBLICATIONS

"Modular Weapons" by Gerald Hendricks, Jan. 1973, *Ordance*.*

* cited by examiner

*Primary Examiner*—J. Woodrow Eldred
(74) *Attorney, Agent, or Firm*—Alston & Bird LLP

(57) ABSTRACT

A universal warhead adapter comprises a tubular sleeve configured to contain any of various warheads of different configurations, and an aft bulkhead designed to replicate the aft end of a standard warhead with which existing tail assemblies are compatible. A universal missile is made by disposing a selected warhead within the sleeve and fixing the warhead therein with fastening mechanisms, and attaching a tail assembly to the aft bulkhead and a nose assembly to the forward end of the sleeve. Control surfaces, rocket motors, and/or turbine engines can be attached directly to the sleeve. An umbilical can be routed internally from a tail assembly through the sleeve and can be connected to an aircraft electrical system via an integral connector attached to the sleeve.

20 Claims, 2 Drawing Sheets

UNIVERSAL WARHEAD ADAPTER, AND MISSILE AND METHOD INCORPORATING SAME

FIELD OF THE INVENTION

The invention relates to warheads and missiles of the type commonly carried by aircraft for deployment therefrom. The invention relates more particularly to methods and devices facilitating commonality of missile configuration among a number of warheads of different configurations.

BACKGROUND OF THE INVENTION

A number of standard types of missiles have been developed for carriage and deployment by aircraft. For example, the AGM-130 uses a 2000-pound Mk-84 warhead forming the body portion of the missile. A tail assembly having a control section is attached to the aft end of the warhead. The AGM-130 missile has a range of about 40 miles. Because of its weight, it is generally unsuitable for carriage by most U.S. fighter aircraft with the exception of the F-15 aircraft.

Other missiles that incorporate the Mk-84 warhead as the missile body include the LGB, GBU-15, and JDAM missiles. In each case, a tail assembly is attached to the aft end of the Mk-84 warhead in order to convert the Mk-84 warhead from a free-fall bomb to a more-accurate guided missile having improved range over the Mk-84 warhead.

More recent warhead technology has enabled warheads having power equivalent to the Mk-84 to be made much lighter. Examples of modern warheads in the 500-pound to 1000-pound weight class include the Mk-82, Mk-83, AUP, I-1000, HTW, I-800, and JAST warheads. In order to enable these warheads to be used for making missiles, a dedicated tail assembly configuration would be needed for each type of warhead, since they are considerably smaller than the Mk-84 warhead and therefore are not compatible with the tail assemblies used in conjunction with the Mk-84 warhead. For example, the assignee of the present application currently has under development three different JDAM tail kits for converting Mk-84, Mk-83 (a 1000-pound warhead), and Mk-82 (a 500-pound warhead) into guided weapons. Still further tail kit configurations would be needed for other warheads.

There is a need for a solution to the problems of lack of commonality among a host of modem warheads and lack of systems for converting the warheads into missiles.

SUMMARY OF THE INVENTION

The above needs are met and other advantages are achieved by the present invention, which provides a universal warhead adapter for use in conjunction with any of a number of warheads of various configurations, thus enabling the warheads to be used with existing tail assemblies to make missiles that can be carried by aircraft using existing aircraft carriage assemblies. To this end, the invention in a preferred embodiment provides a universal warhead adapter comprising a tubular sleeve defining an internal cavity sized to receive a selected one of a plurality of warheads of different predetermined configurations such that the warhead is enclosed by the sleeve. The sleeve has a forward end and an aft end and is aerodynamically and structurally configured to function as a body portion of a missile. The adapter further includes an aft bulkhead at the aft end of the sleeve, the aft bulkhead being configured to permit mounting of a predetermined missile tail assembly onto the aft end of the sleeve. Thus, a common missile configuration is presented by the universal warhead adapter when assembled with a selected warhead and the tail assembly.

The invention thus enables warheads of many sizes, shapes, and weights to be installed into a sleeve of common configuration. The interface between the missile and an aircraft is therefore the same regardless of which warhead is used. A single tail assembly configuration can be used with the various warheads, since there is no need for the tail assembly to be attached directly to the aft end of the warhead. Furthermore, range extension kits such as wings or other control surfaces, rocket motors, or turbojet engines can be attached to the sleeve in order to provide increased range for the missile. Such range extension kits generally cannot be used with existing missiles such as the JDAM in which the warhead itself forms the body of the missile.

The universal warhead adapter preferably includes fastening mechanisms disposed within the sleeve and operable to fix a selected warhead in a predetermined position within the sleeve. The adapter preferably also includes fittings affixed to the sleeve, the fittings being configured to accept attachment lugs to permit the adapter to be carried by a munitions carrier of an aircraft.

The sleeve advantageously comprises a one-piece integral structure, and preferably is an extruded structure. In order to facilitate fuzing of the warhead, the sleeve preferably includes an access door formed through a side wall of the sleeve for access into the internal cavity of the sleeve. The adapter thus enables the practice of fuzing through the control section or tail kit to be eliminated.

An umbilical connector preferably is attached to the sleeve and projects outwardly therefrom, the connector being adapted to be releasably attached to an external wiring harness on an aircraft and to be connected to an internal umbilical disposed within the sleeve. The internal umbilical can be connected to a tail assembly of a missile formed from the universal warhead adapter. The invention thus facilitates the connection of the aircraft electrical system to the missile without having to route an umbilical externally along the missile.

The universal warhead adapter also facilitates the addition of a seeker to the missile. For example, a seeker can be contained within a nose fairing attached to the forward end of the sleeve.

The invention thus provides apparatus and methods enabling warheads of many different sizes, shapes, and weights to be assembled to form a universal missile having a common exterior body portion that can be fitted with tail kits, nose fairings, control surfaces, rocket motors, turbine engines, and other features.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE DRAWINGS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
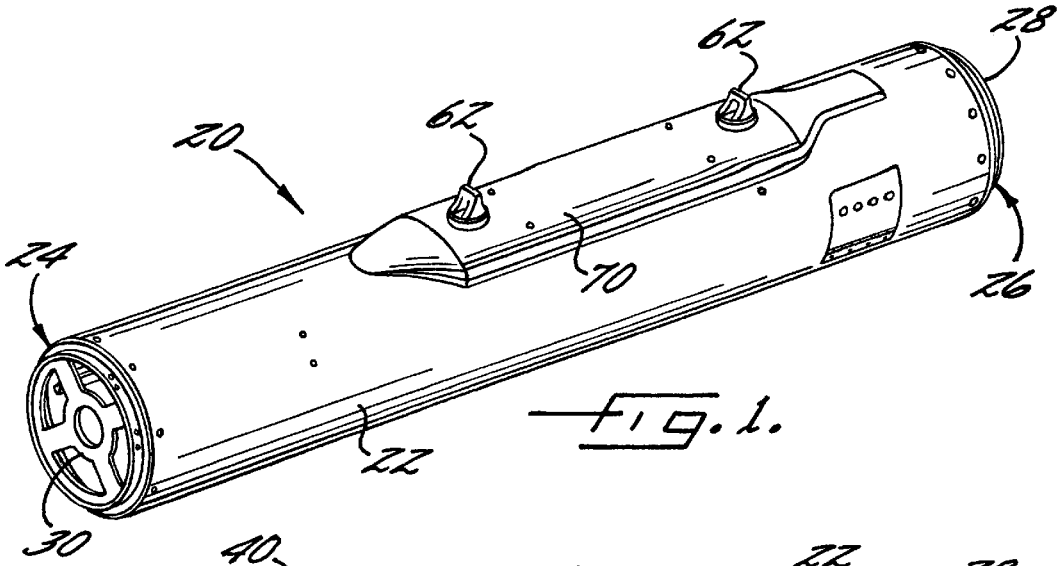
FIG. 1 is a perspective view of a universal warhead adapter in accordance with a preferred embodiment of the invention.
Figure 2:
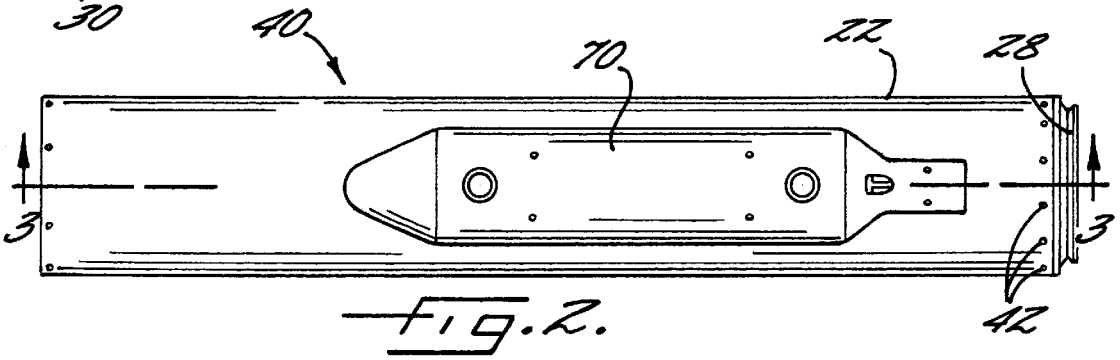
FIG. 2 is a top elevation of a universal warhead adapter in accordance with another embodiment of the invention.

With reference to FIG. 1, a universal warhead adapter 20 in accordance with a preferred embodiment of the invention is shown. The adapter 20 comprises a tubular sleeve 22 having a forward end 24 and an aft end 26, and an aft bulkhead 28 attached to the aft end 26 of the sleeve. The sleeve 22 is adapted to slidably receive a warhead within the sleeve such that the warhead is entirely contained with the sleeve. Fastening mechanisms including a forward frame 30 are used for fixing the warhead within the sleeve 22.

FIGS. 2–5 depict another embodiment of the invention and illustrate in greater detail the manner in which a warhead may be fixed within the sleeve. The universal warhead adapter 40 is similar to the adapter 20 including a tubular sleeve 22 and aft bulkhead 28, except that it includes a forward frame 50 of different construction from the forward frame 30 of the adapter 20. The sleeve 22 preferably is a one-piece cylindrical member, and advantageously can be made by extrusion from aluminum alloy or other suitable material. The aft bulkhead 28 comprises a ring-shaped member partially received within the aft end 26 of the sleeve 22 and affixed therein by fasteners 42 that extend through the side wall of the sleeve into the aft bulkhead 28. A portion of the aft bulkhead 28 projects from the aft end of the sleeve, and this projecting portion is configured to substantially replicate the aft end of a standard warhead, such as the Mk-84 warhead for example.

Figure 3:
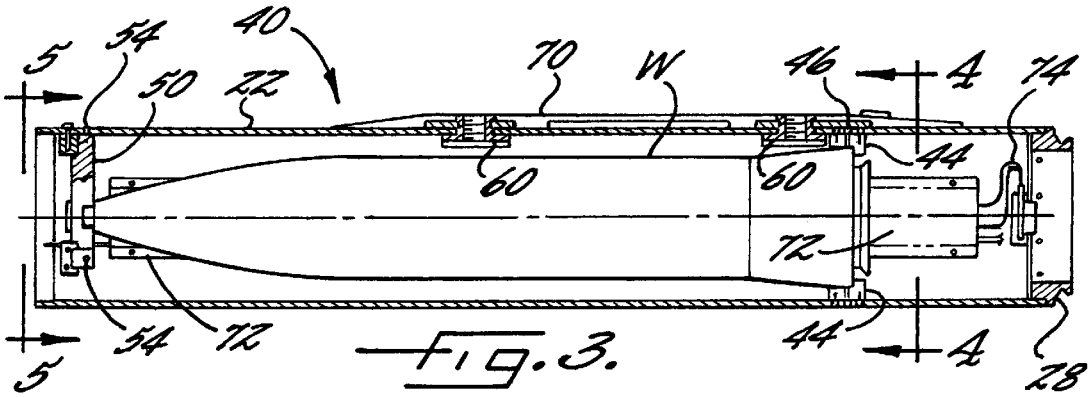
FIG. 3 is a cross-sectional view taken on line 3—3 of FIG. 2, showing a warhead installed within the sleeve.
Figure 5:
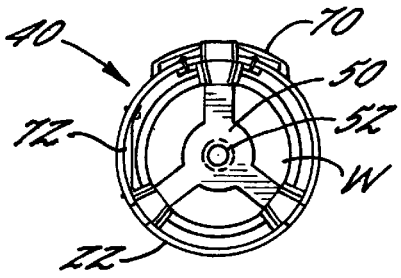
FIG. 5 is a view taken on line 5—5 of FIG. 3, showing a forward frame of the adapter for fixing the forward end of the warhead in the sleeve.
Figure 4:
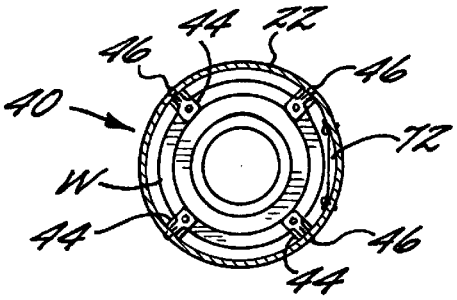
FIG. 4 is a view taken along line 4—4 of FIG. 3, showing fastening mechanisms for fixing the aft end of the warhead within the sleeve.

FIG. 3 illustrates that a warhead W can be inserted into one end of the sleeve 22, and FIGS. 4 and 5 depict fastening mechanisms for fixing the warhead W within the sleeve. More particularly, the aft end of the warhead W is affixed within the sleeve 22 by a plurality of fittings 44 (four fittings 44 being used in the embodiment shown in FIGS. 3–5) that are spaced about the circumference of the aft end of the warhead and fastened with fasteners to the side wall of the sleeve 22. The fittings 44 present surfaces that engage the outer surface of the warhead to prevent radial movement thereof, and also include portions that extend radially inward of the outer surface of the warhead and engage the aft end, such portions preferably being fastened to the warhead so as to prevent both forward and aft movement of the warhead. The fittings 44 preferably include set screws 46 oriented radially. The set screws 46 can be turned in one direction or the other to adjust the fittings 44 for accommodating normal manufacturing tolerances of the various components, so that the warhead W is firmly engaged by the fittings 44.

The forward end of the warhead W is fixed against movement by a forward frame 50. The forward frame 50 includes a threaded hole 52 for receiving a threaded plug (not shown) formed on the forward end of the warhead W. The forward frame 50 is screwed onto the nose of the warhead W, and then the warhead with the frame attached is slid into the sleeve 22. Screws 54 are screwed through the sleeve side wall into each of the legs of the frame 50 to secure the frame to the sleeve 22.

The universal warhead adapter 40 also includes a pair of fittings 60 attached to the top side of the sleeve 22 for accepting standard lugs 62 (FIG. 1) that are configured to be engaged by an aircraft carriage and launching device (not shown), such that a missile having the adapter 40 can be carried by and launched from an aircraft. Each fitting 60 is formed preferably as a short section of circular pipe joined at one end to a circular-arc plate having a through-hole aligned with the hole in the pipe. Holes are formed through the side wall of the sleeve 22, and the pipe portions of the fittings 60 are inserted from inside the sleeve into the holes and the circular-arc plate portions of the fittings 60 are screwed onto the sleeve side wall. The pipe portions of the fittings 60 are long enough to protrude slightly outward from the sleeve outer surface.

The universal warhead adapters 20, 40 shown in the drawings also include a mating plate 70 attached to the top side of the sleeve 22. The mating plate 70 was added for purposes of a flight testing program in which a missile having a universal warhead adapter in accordance with the invention was attached to the pylon assembly of an Air Force F-15 fighter aircraft. The purpose of the mating plate 70 was to conform the upper surface of the sleeve 22, which interfaces with sway braces of the aircraft pylon assembly, to the configuration of a conventional AGM-130 missile. More particularly, a conventional AGM-130 missile has a body whose outer diameter is about 18 inches, and the sway braces of the aircraft pylon assembly are configured to mate with this body configuration. On the other hand, the sleeve of the universal warhead adapter that was tested had an outer diameter of about 16 inches. The mating plate 70 was designed to replicate the configuration of the 18-inch AGM-130 missile body so that the sway braces of the aircraft could be used without modification.

The universal warhead adapter 40 preferably also includes a cover 72 (FIGS. 3–5) attached to the inner surface of the sleeve 22 and extending most of the length of the sleeve. The cover 72 and inner surface of the sleeve 22 define a channel therebetween for routing an electrical wiring harness 74 (FIG. 3) from the forward end of the sleeve to the aft end of the sleeve so that a seeker (not shown) attached to the forward end of the sleeve can be electrically connected to a missile control section (not shown) attached to the aft end of the sleeve.

Figure 6:
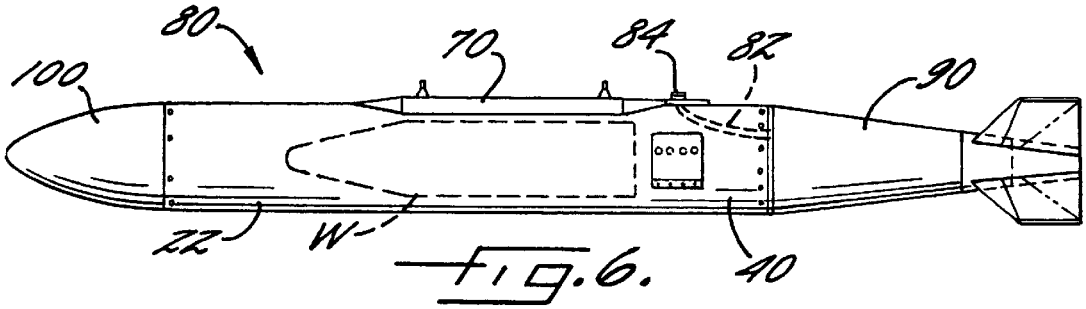
FIG. 6 is a side elevation of a missile formed from a universal warhead adapter assembled with a nose fairing and tail assembly.

The universal warhead adapter of the invention enables a wide variety of missile configurations to be built having a common body portion formed by the sleeve 22. Accordingly, by configuring the sleeve 22 to be compatible with existing aircraft carriage assemblies, a wide variety of warhead and missile types can be carried by existing aircraft without necessitating modifications to such aircraft. FIG. 6 shows one such missile 80 generally corresponding to a JDAM missile. The missile 80 includes a universal warhead adapter 40 containing a warhead W shown schematically in dashed lines, a tail assembly 90 attached to the aft end of the adapter 40, and a nose fairing 100 attached to the forward end of the adapter 40. FIG. 6 also illustrates that an internal umbilical 82 connected to the tail assembly 90 can be routed internally through the sleeve 22 and attached to an umbilical connector 84 that extends through the sleeve side wall and is exposed at the top side of the sleeve. The umbilical connector 84 can interface with an external umbilical or wiring harness (not shown) contained within an aircraft pylon or other carriage and launching device. When the missile 80 is launched and falls away from the aircraft, the external umbilical detaches from the connector 84. The invention thus facilitates elimination of the conventional practice of attaching a sheet metal housing to the top of the missile body for routing the umbilical from the tail assembly to the aircraft wiring harness.

Figure 7A:
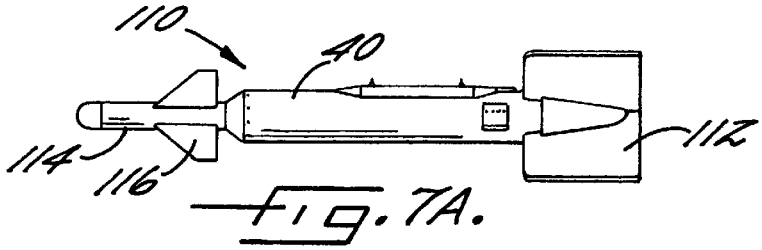
FIGS. 7A–E are side elevations of various missile configurations formed with the universal warhead adapter assembled with various nose assemblies, tail assemblies, control surfaces, and/or propulsion packages.

FIGS. 7A–E show various other missile configurations that can be built using the warhead adapter of the present invention. FIG. 7A depicts a missile 110 corresponding generally to a GBU-24 missile. The missile 110 includes a tail assembly 112 and a nose assembly 114 with forward control surfaces 116. The missile 110 provides a substantial weight reduction relative to a conventional GBU-24 missile by replacing the standard 2000-pound Mk-84 warhead with a 1000-pound warhead contained with the universal warhead adapter 40 (which weighs approximately 200 pounds).

Figure 7B:
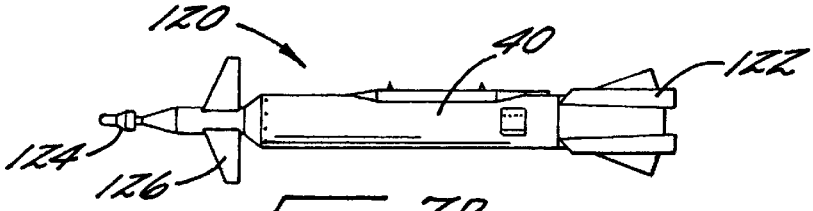

FIG. 7B depicts a missile 120 corresponding generally to a GBU-10 missile. The missile 120 includes a tail assembly 122 and a nose assembly 124 with forward control surfaces 126. Again, the invention enables a substantial weight reduction relative to a conventional GBU-10 missile using a Mk-84 warhead.

Figure 7C:
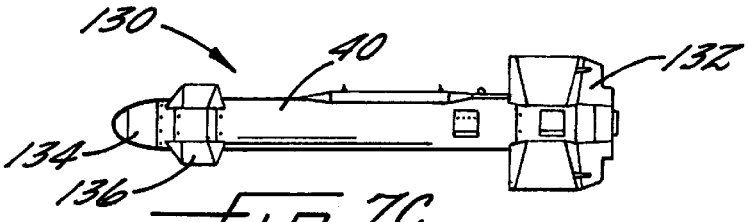

FIG. 7C depicts a missile 130 corresponding generally to a GBU-15 missile. The missile 130 includes a tail assembly 132 and a nose assembly 134 with forward control surfaces 136.

Figure 7D:
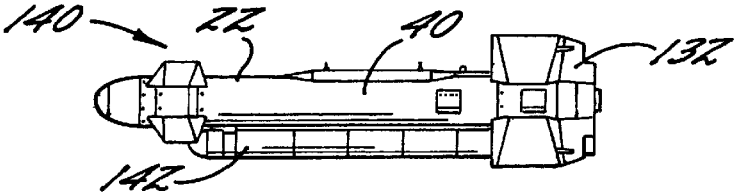

FIG. 7D depicts a missile 140 corresponding generally to an AGM-130 missile. The missile 140 includes a tail assembly 132 and nose assembly 134 identical to those of the missile 130, but further includes a rocket motor 142 attached to the sleeve 22 for further extending the range of the missile.

Figure 7E:
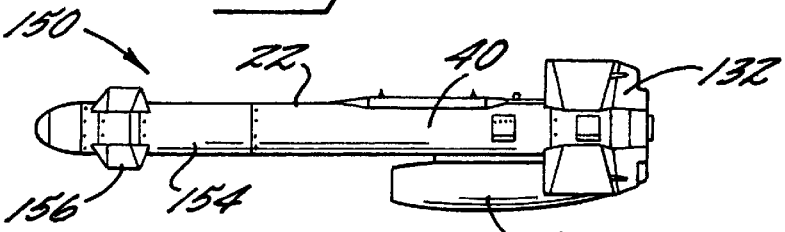

FIG. 7E depicts a missile 150 corresponding generally to an AGM-130 missile. The missile 150 includes the same tail assembly 132 as the missiles 130 and 140. The missile 150 also includes a turbojet engine 152 attached to the sleeve 22 for extending the range of the missile. An extended nose assembly 154 is provided with forward control surfaces 156.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An adapter for housing warheads of various configurations, comprising:

a tubular sleeve defining an internal cavity sized to receive a selected one of a plurality of warheads of different predetermined configurations such that the warhead is enclosed by the sleeve, the sleeve having a forward end and an aft end and being aerodynamically and structurally configured to function as a body portion of a missile;

a forward frame for securing a warhead against movement within the sleeve, the forward frame being configured to releasably attach to a nose end of the warhead and being slidable into the sleeve and attachable to the sleeve; and an aft bulkhead at the aft end of the sleeve, the aft bulkhead being configured to permit mounting of a predetermined missile tail assembly onto the aft end of the sleeve;

whereby a common missile configuration is presented by the universal warhead adapter when assembled with a selected warhead and the tail assembly.

2. The universal warhead adapter of claim 1, further comprising fastening mechanisms disposed within the sleeve and operable to fix a selected warhead in a predetermined position within the sleeve.

3. The universal warhead adapter of claim 1, further comprising fittings affixed to the sleeve, the fittings being configured to accept lugs to permit the adapter to be carried by a munitions carrier of an aircraft.

4. The universal warhead adapter of claim 1, wherein the sleeve comprises a one-piece integral structure.

5. The universal warhead adapter of claim 4, wherein the sleeve is an extruded structure.

6. The universal warhead adapter of claim 1, wherein the sleeve includes an access door formed through a side wall of the sleeve for access into the internal cavity of the sleeve.

7. The universal warhead adapter of claim 1, further comprising an umbilical connector attached to the sleeve and projecting outwardly therefrom, the connector being adapted to be releasably attached to an external umbilical on an aircraft and to be connected to an internal umbilical disposed within the sleeve.

8. The universal warhead adapter of claim 1, further comprising aerodynamic control surfaces affixed to outer surfaces of the sleeve.

9. A universal missile, comprising:

a tubular sleeve defining an internal cavity of sufficient size to receive any one of a plurality of warheads of different predetermined configurations, the sleeve having a forward end and an aft end and being aerodynamically and structurally configured to function as a body of the missile;

a warhead selected from said plurality of warheads, the warhead being disposed within the cavity so as to be enclosed by the sleeve;

a forward frame for securing the warhead against movement within the sleeve, the forward frame being releasably attached to a nose end of the warhead and being slidable into the sleeve and attached to the sleeve;

a tail assembly attached to the aft end of the sleeve; and a nose assembly attached to the forward end of the sleeve.

10. The universal missile of claim 9, further comprising fastening mechanisms disposed within the sleeve and operable to fix the warhead in a predetermined position within the sleeve.

11. The universal missile of claim 9, further comprising lugs affixed to the sleeve, the lugs being adapted to permit the missile to be carried by a munitions carrier of an aircraft.

12. The universal missile of claim 9, further comprising an aft bulkhead affixed to the aft end of the sleeve, the tail assembly being attached to the aft bulkhead.

13. The universal missile of claim 9, wherein the sleeve includes an access door formed through a side wall of the sleeve for access into the internal cavity of the sleeve.

14. The universal missile of claim 9, further comprising a rocket motor attached to the sleeve.

15. The universal missile of claim 9, further comprising a turbine engine attached to the sleeve.

16. A method for making missiles comprising:

providing a warhead having a predetermined diameter and a missile tail assembly adapted to be attached directly to an aft end of a selected standard warhead having a diameter greater than said predetermined diameter;

enclosing the warhead having the predetermined diameter within a tubular sleeve having an aft end configured to mate with the tail assembly, and securing the warhead against movement within the sleeve by a plurality of fastening mechanisms including a forward frame that is releasably attached to a nose end of the warhead and is slid into the sleeve and secured thereto;

attaching the tail assembly to the aft end of the sleeve; and attaching a nose assembly to a forward end of the sleeve.

17. The method of claim 16, further comprising providing an aft bulkhead at the aft end of the sleeve, the aft bulkhead being configured to substantially replicate the aft end of the selected standard warhead, and wherein the tail assembly is attached to the aft bulkhead.

18. The method of claim 16, further comprising attaching a rocket motor to the sleeve.

19. The method of claim 16, further comprising attaching a turbine engine to the sleeve.

20. The universal missile of claim 9, further comprising a cover disposed within the sleeve and forming a channel between the cover and an inner surface of the sleeve for routing an electrical cable through the channel.

* * * * *